US010683738B2

(12) United States Patent
Leniek, Sr.

(10) Patent No.: US 10,683,738 B2
(45) **Date of Patent: *Jun. 16, 2020**

(54) LIQUEFIED GAS-DRIVEN PRODUCTION SYSTEM

(71) Applicant: CTLift Systems LLC, Houston, TX (US)

(72) Inventor: Humberto Leniek, Sr., Houston, TX (US)

(73) Assignee: CTLift Systems LLC, Houston, TX (US)

( * ) Notice: Subject to any disclaimer, the term of this patent is extended or adjusted under 35 U.S.C. 154(b) by 1114 days.

This patent is subject to a terminal disclaimer.

(21) Appl. No.: 14/720,678

(22) Filed: May 22, 2015

(65) Prior Publication Data

US 2016/0298432 A1 Oct. 13, 2016

Related U.S. Application Data

(60) Provisional application No. 62/178,376, filed on Apr. 9, 2015.

(51) Int. Cl.
*E21B 43/12* (2006.01)

(52) U.S. Cl.
CPC ..... *E21B 43/129* (2013.01)

(58) Field of Classification Search
CPC ..... E21B 43/129; E21B 2043/125; E21B 43/122; E21B 47/06; E21B 43/123
See application file for complete search history.

(56) References Cited

U.S. PATENT DOCUMENTS

| | | | |
|---|---|---|---|
| 4,397,612 | A | 8/1983 | Kalina |
| 4,708,595 | A | 11/1987 | Maloney et al. |
| 5,785,500 | A | 7/1998 | Leniek |
| 5,971,069 | A | 10/1999 | Stoy et al. |
| 6,318,468 | B1 | 11/2001 | Zakiewicz |
| 6,354,377 | B1 | 3/2002 | Averhoff |
| 6,629,566 | B2 | 10/2003 | Liknes |
| 6,663,350 | B2 | 12/2003 | Tyree, Jr. |

(Continued)

OTHER PUBLICATIONS

"U.S. Application As Filed", dated May 22, 2015, filed concurrently herewith, "Liquefied Gas-Driven Gas-Lift System", 15 pgs.

*Primary Examiner* — James G Sayre
(74) *Attorney, Agent, or Firm* — Daniel J. Krueger

(57) ABSTRACT

One illustrative artificial lift method includes deriving compressed natural gas (CNG) from liquefied natural gas (LNG) and employing the CNG to hydraulically drive a downhole pump that forces fluid from the well. An illustrative system embodiment includes an evaporator, a controller, and a downhole pump. The evaporator converts LNG into CNG, which the controller employs to alternately pressurize and depressurize a hydraulic line. The downhole pump includes a plunger that performs a pump stroke in response to the pressurization and a return stroke in response to the depressurization; these pump and return strokes operate to force fluid from a well. Further disclosed herein is the use of a virtual pipeline to supply LNG for such artificial lift systems and methods. It includes: liquefying natural gas to fill a transport trailer at an offsite facility; transporting the trailer to a site of a well; and coupling the trailer to surface equipment.

20 Claims, 2 Drawing Sheets

(56) References Cited

U.S. PATENT DOCUMENTS

| | | | | |
|---|---|---|---|---|
| 6,745,857 | B2 | 6/2004 | Gjedebo | |
| 8,571,688 | B2 | 10/2013 | Coward | |
| 8,657,014 | B2 * | 2/2014 | Rogers | E21B 43/00 166/372 |
| 8,789,609 | B2 * | 7/2014 | Smith | E21B 43/129 166/372 |
| 2004/0065441 | A1 * | 4/2004 | Bosley | E21B 43/122 166/372 |
| 2006/0045767 | A1 * | 3/2006 | Liknes | F04B 53/12 417/415 |
| 2006/0124298 | A1 * | 6/2006 | Geier | E21B 43/129 166/250.15 |
| 2007/0039728 | A1 | 2/2007 | Coddou | |
| 2011/0214880 | A1 * | 9/2011 | Rogers | E21B 43/00 166/372 |
| 2014/0262292 | A1 * | 9/2014 | Joseph | E21B 43/26 166/308.1 |
| 2015/0121906 | A1 * | 5/2015 | Anderson | F17C 9/02 62/50.5 |
| 2015/0211684 | A1 * | 7/2015 | Santos | F17C 5/06 137/1 |
| 2015/0377000 | A1 * | 12/2015 | Bollingham | E21B 43/168 166/53 |
| 2016/0230519 | A1 * | 8/2016 | Leniek, Sr. | E21B 43/122 |

* cited by examiner

LIQUEFIED GAS-DRIVEN PRODUCTION SYSTEM

CROSS-REFERENCE TO RELATED APPLICATIONS

The present application claims priority to Provisional U.S. Pat. App. No. 62/178,376, titled "CNG Gas-Driven Pump and Production System" and filed Apr. 9, 2015 by inventor Humberto Leniek, and relates to U.S. patent application Ser. No. 14/720,677, titled "Liquefied Gas-Driven Gas-Lift System", by inventor Humberto Leniek, which has been filed concurrently herewith. Each of these references is hereby incorporated by reference in their entirety.

BACKGROUND

Hydrocarbon reservoirs are generally formed by traps in the geologic structure, where the less buoyant ground water is displaced by rising hydrocarbons. When these reservoirs are first accessed, the fluid in the rock pores generally enters the well with sufficient pressure to carry the fluids to the surface. However, depending on the rate at which fluids are produced, this pressure generally falls over time, reducing the natural "lift" in the well and making the well unable to continue producing at an adequate rate on its own. (The natural lift can also be inhibited by the accumulation of dense fluids that create a large hydrostatic pressure in the wellbore.) To address these issues, oil producers have developed "artificial lift", a term that covers a wide variety of techniques for conveying fluid to the surface.

For the most part, these techniques require a source of power, e.g., fuel or electricity, to drive a motor on the surface or downhole. The raw hydrocarbons produced by the well itself are generally unsuitable for use as fuel, presenting a challenge for supplying artificial lift to remotely-located wells.

SUMMARY

Accordingly, there is disclosed herein an illustrative embodiment of an artificial lift method that includes deriving compressed natural gas (CNG) from liquefied natural gas (LNG) and employing the CNG to hydraulically drive a downhole pump that forces fluid from the well.

Also disclosed herein is an illustrative embodiment of an artificial lift system that includes an evaporator, a controller, and a downhole pump. The evaporator converts liquefied natural gas (LNG) into compressed natural gas (CNG). The controller employs the CNG to alternately pressurize and depressurize a hydraulic line. The downhole pump includes a plunger that performs a pump stroke in response to the pressurization and a return stroke in response to the depressurization; these pump and return strokes operate to force fluid from a well.

Further disclosed herein is an illustrative embodiment of an artificial lift method employing a virtual pipeline. The virtual pipeline method includes: liquefying natural gas to fill a transport trailer at an offsite facility; transporting the trailer to a site of a well; and coupling the trailer to surface equipment to enable the surface equipment to obtain liquefied natural gas (LNG) as needed for hydraulically driving a downhole pump that forces fluid from the well.

Each of the disclosed embodiments may further include one or more of the following additional features in any combination: (1) the deriving includes raising a temperature of LNG trapped in a restricted volume. (2) the LNG is transported to the well site by trailer from an offsite facility. (3) the employing includes alternately pressurizing a hydraulic line with the CNG, thereby forcing a plunger to transfer fluid to a lift conduit, and depressurizing the hydraulic line, thereby enabling a return stroke of the plunger. (4) motion of the plunger translates a traveling check valve relative to a stationary check valve. (5) the well includes an inner production tubular defining an inner conduit. (6) the well includes an outer production tubular defining an annular conduit between the inner production tubular and the outer production tubular. (7) the inner production tubular is terminated by the downhole pump. (8) the inner conduit serves as the hydraulic line and the annular conduit serves as the lift conduit. (9) an alternation of pressurizing and depressurizing the hydraulic line is paused to enable fluid to accumulate in the well. (10) the pausing is contingent upon detecting a change in injection pressure. (11) the pausing is contingent upon detecting a flow rate condition at an upper end of the lift conduit. (12) a transport trailer is coupled to provide LNG to the evaporator. (13) once emptied, the trailer is replaced with a non-empty trailer of LNG. (14) the emptied trailer is returned to the offsite facility for refilling with LNG.

Figure 1:
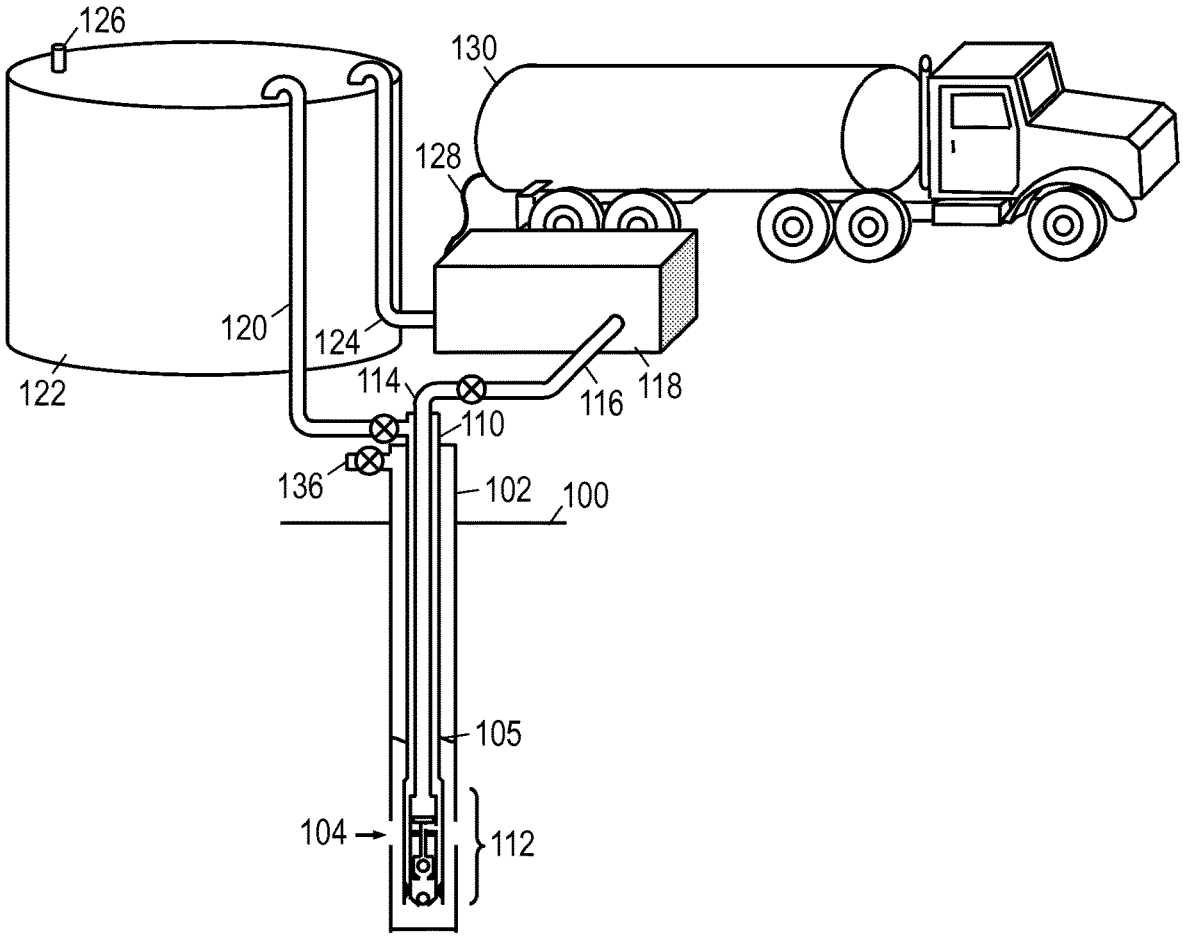
FIG. 1 shows an illustrative liquefied gas-driven production system.

It should be understood, however, that the specific embodiments given in the drawings and detailed description do not limit the disclosure. On the contrary, they provide the foundation for one of ordinary skill to discern the alternative forms, equivalents, and modifications that are encompassed together with one or more of the given embodiments in the scope of the appended claims.

NOMENCLATURE

In the following description, the term "fluid" is employed for liquids, gases, and mixtures thereof, whether or not they may be laden with solid particulates. The term "tubular" is employed as a generic term for piping of every sort that might be found in an oil, gas, or water well, including coiled (steel) tubing, continuous (composite) tubing, and strings of threaded tubing with regular or premium threads. The term tubular applies to small and large diameter tubing whether employed as drill pipe, casing, production tubing, or service strings. "Conduit" is employed as a generic term for any of the various fluid flow passages including the central bore of a tubular or the annular space around an inner tubular that is perhaps defined with the help of an outer tubular.

DETAILED DESCRIPTION

FIG. 1 shows a borehole extending downward from the Earth's surface 100 and lined with a casing tubular 102. Though the well is shown as a straight vertical hole, it may in practice deviate from the vertical and extend for quite some distance in a horizontal direction, in some cases following a tortuous trajectory. At one or more positions along its length, the casing tubular 102 may be perforated to enable formation fluid 104 to enter and accumulate in the interior. The pressure of fluid in the formation pores forces the fluid to a height indicated by interface 105.

An outer production tubular 110 extends from the surface 100 to below the fluid interface 105, terminating with a pump assembly hanger 242, or "seating nipple", (FIG. 2A) for receiving a pump assembly 112. The pump assembly 112 is attached to the end of an inner production tubular 114 and lowered into the outer production tubular 110 until the pump assembly 112 is anchored to the hanger 242, fixing the pump assembly in place and sealing the bottom end of an annular conduit between the inner and outer production tubulars. Various suitable hanger constructions are disclosed in the literature, including a J-slot mechanical packer, a swellable packer, mechanical hold down, or cup-type hold down.

The central bore of the inner production tubular 114 defines an inner conduit that is coupled via a pressure line 116 to a surface unit 118. The surface unit 118 employs the pressure line 116 and inner production tubular 114 as a hydraulic line, alternately pressurizing and depressurizing it to drive a plunger in the downhole pump assembly 112. As explained in greater detail by FIGS. 2A-2B, this action causes the pump assembly 112 to force fluid 104 up the annular conduit to the surface, where a production line 120 carries the fluid to a storage tank 122.

Storage tank 122 holds the produced fluids until they can be transported to an offsite facility. In addition, tank 122 may serve as a gas separation unit, with gas moving through a recovery line 124 to surface unit 118 for potential compression and recycling. A safety valve 126 prevents the storage tank 122 from becoming over-pressured.

A supply line 128 couples the surface unit 118 to a source of liquefied natural gas (LNG), such as a cryogenic transport trailer 130 or an on-site LNG storage tank. LNG is natural gas (predominately methane, with small amounts of ethane, propane, butane, and heavier alkanes) that has been cooled below about −162° C. It is normally stored below about 4 psi as a boiling cryogen, meaning that heat leakage through the insulation gets consumed and dissipated by the phase change of some of the liquid to gaseous phase. Once the LNG in one trailer has been mostly consumed, that trailer may be supplemented or replaced with a full trailer. An offsite facility liquefies the natural gas and refills the empty trailers for transport back to the well site.

FIG. 1 further shows an access line 136 for accessing the annular conduit between the outer production tubular 110 and casing 102. It may be used for controlling pressure in this region and/or for circulating treatment fluids to service the well.

Figure 2A:
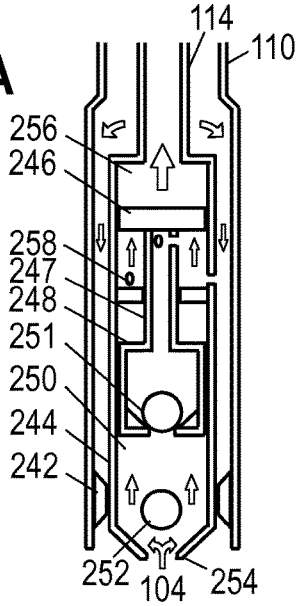
FIG. 2A shows an illustrative downhole pump's return stroke or "Upstroke".
Figure 2B:
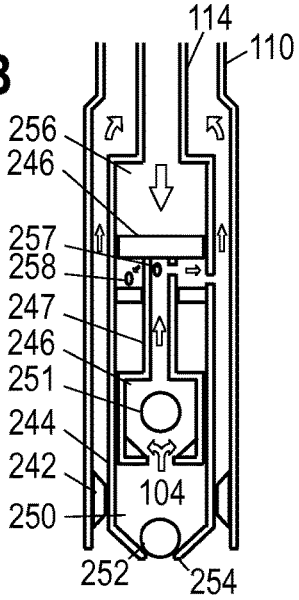
FIG. 2B shows an illustrative downhole pump stroke or "Downstroke".

FIGS. 2A and 2B show the pump assembly 112 in more detail. A hanger 242 secures the pump body 244 in place, sealing the annular conduit and preventing unwanted motion relative to the outer production tubular 110. Inside the pump body 244 of FIG. 2A, a piston 246 uses a shaft 247 to pull a traveling chamber 248 upward through an intake chamber 250. (Piston 246, shaft 247, and chamber 248, are integrated to form the pump's plunger.) Because a traveling check valve 251 is closed, this motion causes fluid 104 to lift the stationary check valve 252 off of its seat 254 as the fluid 104 enters the intake chamber. A reduced pressure in power chamber 256 enables hydrostatic pressure of fluid in the annular conduit to force fluid through the ports 258 and drive piston 246 upwards.

In FIG. 2B, an increased pressure in power chamber 256 forces the piston 246 downward. This action reseats the stationary check valve 252, preventing the fluid 104 in intake chamber 250 from returning in that direction. Rather, the fluid 104 is forced to open the traveling check valve 251 and to enter the traveling chamber 246. From the traveling chamber 246, the fluid is forced through the connecting shaft 247, to exit through ports 257 and 258 to enter the annular conduit. At the end of this downward pump stroke, the traveling valve 251 recloses and the return stroke of FIG. 2A begins.

By alternately depressurizing and pressurizing the power chamber, the surface unit causes fluid to be drawn into the intake chamber on the return stroke and then forced into the annular conduit on the pump stroke. Repetition enables the fluid to be lifted via the annular conduit to the surface. Though in the illustrated embodiment, the central conduit acts as the hydraulic line and the annular conduit acts as the lift conduit, their roles may be switched via a crossover flow unit or via a reconfiguration of the pump assembly itself. In another alternative embodiment, the casing acts as the outer production tubular, enabling the number of tubulars to be reduced by one (so long as all production zones are below the pump).

Figure 3:
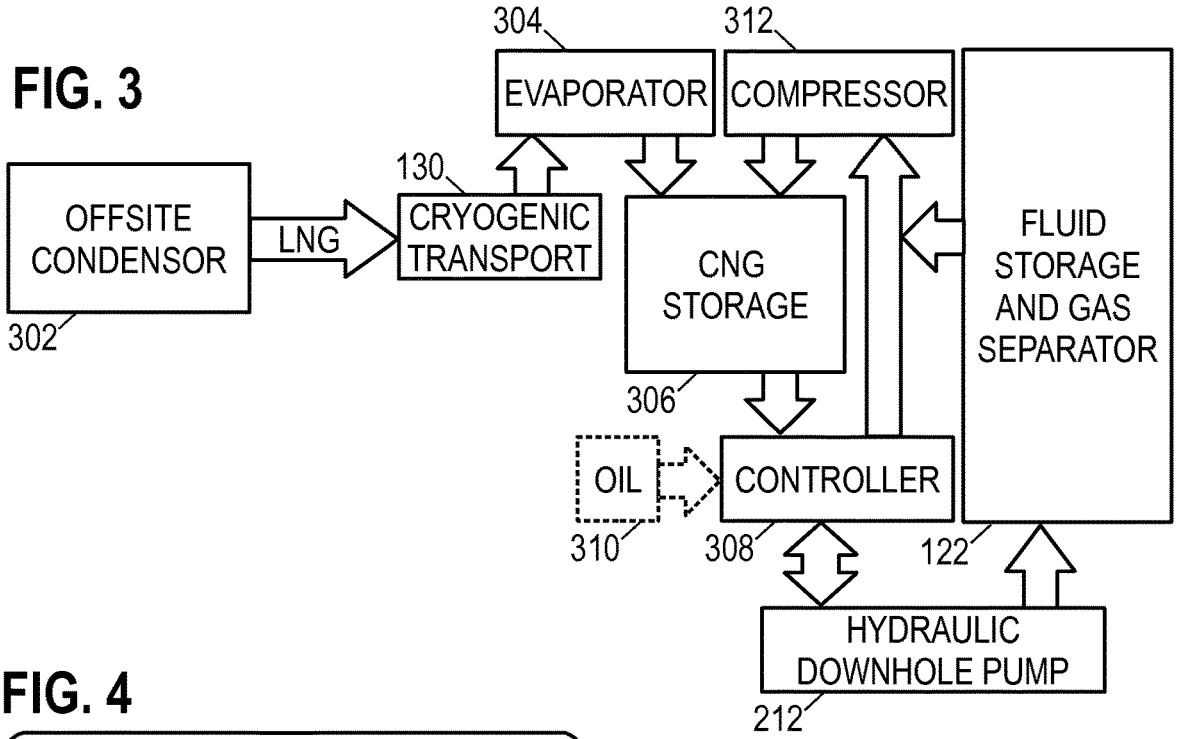
FIG. 3 is a function-block diagram of an illustrative artificial lift system.

The functional modules of the surface unit 118 correspond to blocks 304, 306, 308, 310, and 312 of FIG. 3. An offsite condenser 302 accepts natural gas from a pipeline or other source and liquefies it to form LNG, which is loaded on a cryogenic transport trailer 130. A truck driver hauls the LNG-filled trailer to the well site and couples it to the surface unit 118. An evaporator 304 converts the LNG to compressed natural gas (CNG), e.g., by warming the LNG in a confined volume.

A CNG storage module 306 stores the CNG at ambient temperature with a pressure in the range of 2900 to 3600 psi. Depending on the production characteristics of the well, the volume of the CNG storage module may range from relatively small (i.e., enough to pressurize the hydraulic line for a limited number of cycles) to relatively large (i.e., enough to fill one or more LNG transport trailers).

A controller module 308 includes electronics for opening and closing valves, for acquiring measurements of fluid flow rates and pressures, and further includes a processor executing software or firmware that coordinates the operation of the valves to control the various modules. Among the operations facilitated by the controller module 308 is the alternate pressurizing and depressurizing of the hydraulic line to drive the downhole pump assembly 212 and thereby lift fluid from the well into the fluid storage tank 122. The gas released from the depressurization cycle, as well as any gas derived from the storage tank 122, is directed to an optional compressor 312 for recycling into the form of CNG. Alternatively, or in addition, such gas may be combusted by a generator or may be otherwise converted into electricity to satisfy the power requirements of the various modules of surface unit 118.

FIG. 3 further shows an optional oil module 310, which may supply hydraulic fluid or some other incompressible fluid into the hydraulic line to occupy most of the volume and to lubricate the motion of any pistons. Filling most of the hydraulic line volume with an incompressible fluid enables the pressurization and depressurization to be accomplished with a minimal volume of CNG. A piston in the surface unit 118 may optionally be employed to maintain separation between the CNG and the hydraulic fluid.

Figure 4:
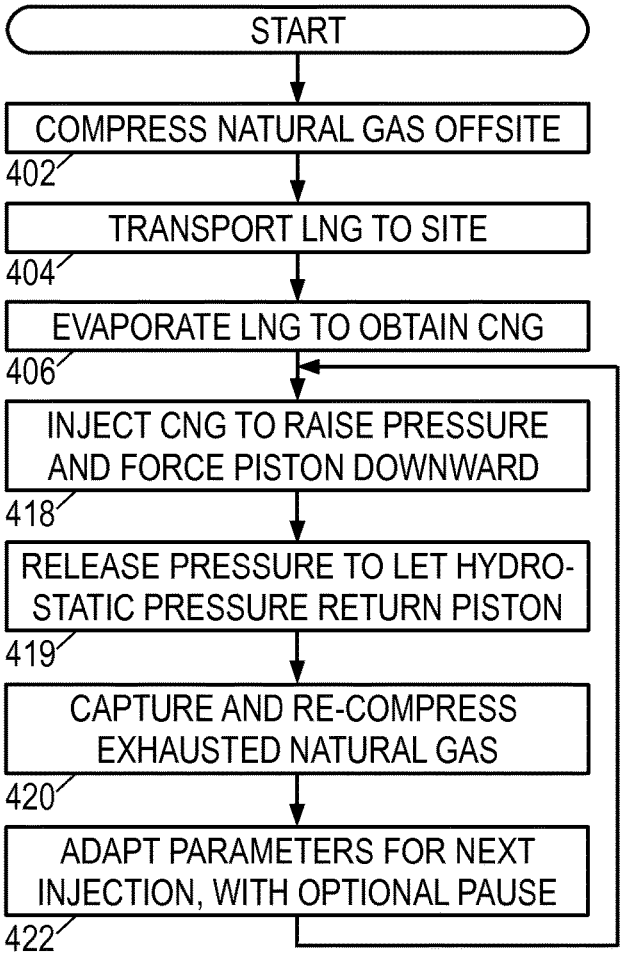
FIG. 4 is a flow diagram of an illustrative artificial lift method.

FIG. 4 is a flow diagram of an illustrative artificial lift method embodiment. It begins in block 402 with liquefying natural gas at an offsite facility to fill a cryogenic transport trailer with LNG. In block 404, the LNG is transported to the well site and coupled to the surface unit to supply LNG as needed for driving the downhole pump.

In block 406, the system evaporates the LNG to obtain CNG. If such evaporation is performed in a confined volume, the LNG is converted directly to CNG without requiring a compressor. Alternatively, some of the gas may be combusted to power a compressor that converts the evaporated LNG into CNG.

Blocks 418-422 form a cycle that is repeatedly performed by controller module 308. In block 418, the controller 308 opens an injection valve, permitting CNG to pressurize the hydraulic line and thereby force the piston in the downhole pump to perform a downstroke as described above. It is contemplated that the injected pressure will be an adapted parameter that is modified as needed to maximize efficiency, but it could range as high as the full storage pressure of the CNG, e.g., around 3500 psi. The surface piston and/or the piston in the downhole pump can further employ a mechanical advantage to magnify the effective lift provided by the pump.

In block 419, the controller 308 closes the injection valve and opens a release valve, thereby depressurizing the hydraulic line and permitting the hydrostatic pressure in the lift conduit to force the downhole pump plunger to perform a return stroke (or upstroke) as described above. It is contemplated that the release pressure will be another adapted parameter to be modified as necessary to maximize efficiency, but could range as low as atmospheric pressure.

In block 420, the exhausted gas is captured to be combusted as fuel or to be recompressed as CNG. Less desirably, the exhausted gas may be vented. In block 422, the controller 308 processes the sensor measurements and adapts the parameters for the next cycle. Optionally, the controller may institute a pause to permit additional well fluid to accumulate downhole.

Among the sensor measurements that may be acquired by the controller 308 are the pressure peak and valley values in the hydraulic line, augmented by a measurement of the derivatives and/or the CNG flow rates during each half of the cycle. The controller 308 may additionally or alternatively acquire the produced volume or average flow rate for liquid in the production line. Another potentially useful sensor measurement is the pressure in the production line. From these measurements, the controller can derive information such as stroke length, produced liquid volume per cycle, actual injected CNG volume and/or mass per cycle, actual injection rate, optimal CNG volume and/or mass per cycle, optimal injection rate, optimal pressurization/depressurization frequency and duty cycle, efficiency, and LNG usage rate.

The illustrative embodiments disclosed above may prove advantageous in that they minimize the number of moving components. Downhole, the sole moving components are the plunger assembly and the two check valves. At the surface, the sole moving components are the valves, the optional compressor, and the optional hydraulic piston. Thus the reliability of these illustrative embodiments is expected to be very high and suitable for use in very remote areas.

Nevertheless, in less remote areas, the illustrated embodiments can be augmented with an on-site condenser for producing LNG. In certain alternative embodiments, a single on-site condenser or a single cryogenic LNG trailer may be used to supply the surface units 118 of multiple wells in a localized region. Still other embodiments may employ an off-site compressor to fill CNG transport trailers, and may transport those trailers to the well site to be used as a CNG source and optional CNG storage without need of an evaporator.

Moreover, the use of a hydraulically-driven downhole pump means that the illustrative embodiments can be used in highly-deviated, extended reach wells having high tortuosity or other factors that would render traditional artificial lift systems unusable.

Though the check valves in the illustrative downhole pump assembly are ball-and-seat valves, other check valve configurations are known and may be used. Suitable alternatives include flapper valves, reed valves, and sliding sleeve valves.

Numerous other variations and modifications will become apparent to those skilled in the art once the above disclosure is fully appreciated. The ensuing claims are intended to cover such variations where applicable.

I claim:

1. An artificial lift method that comprises:

deriving compressed natural gas (CNG) from liquefied natural gas (LNG); and employing the CNG to hydraulically drive a downhole pump plunger that forces fluid from the well, wherein said employing includes pressurizing a hydraulic line with the CNG, thereby forcing a downhole pump plunger to transfer fluid to a lift conduit, said method further comprising depressurizing the hydraulic line, thereby enabling a return stroke of the plunger.

2. The method of claim 1, wherein said deriving includes raising a temperature of LNG trapped in a restricted volume.

3. The method of claim 1, further comprising:

transporting liquefied natural gas (LNG) to a site of the well.

4. The method of claim 1, wherein motion of the plunger translates a traveling check valve relative to a stationary check valve.

5. The method of claim 1, wherein the well includes an inner production tubular defining an inner conduit, wherein the well further includes an outer production tubular defining an annular conduit between the inner and outer production tubulars, the outer production tubular being coiled tubing, and wherein the inner production tubular is terminated by the downhole pump.

6. The method of claim 5, wherein said inner conduit serves as the hydraulic line and the annular conduit serves as the lift conduit.

7. The method of claim 5, wherein said annular conduit serves as the hydraulic line and the inner conduit serves as the lift conduit.

8. The method of claim 1, further comprising:

pausing an alternation of the pressurizing and depressurizing to enable fluid to accumulate in the well.

9. The method of claim 8, wherein said pausing is contingent upon detecting a change in injection pressure.

10. The method of claim 8, wherein said pausing is contingent upon detecting a flow rate condition at an upper end of the lift conduit.

11. The method of claim 1, wherein motion of the downhole pump plunger is limited by a downhole pump body.

12. An artificial lift system that comprises:

an evaporator that converts liquefied natural gas (LNG) into compressed natural gas (CNG);

a controller that employs the CNG to alternately pressurize and depressurize a hydraulic line; and a downhole pump having a plunger that performs a pump stroke in response to the pressurization and a return stroke in response to the depressurization, said pump and return strokes operating to force fluid from a well.

13. The system of claim 12, further comprising a transport trailer coupled to provide LNG to the evaporator.

14. The system of claim 12, wherein the downhole pump includes a stationary check valve and the plunger moves a traveling check valve relative to the stationary check valve.

15. The system of claim 12, wherein the well includes an inner production tubular defining an inner conduit, wherein the well further includes an outer production tubular defining an annular conduit between the inner and outer production tubulars, wherein the inner production tubular is terminated by the downhole pump; and wherein said inner conduit serves as the hydraulic line and the annular conduit serves as the lift conduit.

16. The system of claim 15, wherein the controller periodically pauses the alternation of the pressurizing and depressurizing to enable fluid to accumulate in the outer production tubular.

17. The system of claim 12, wherein motion of the downhole pump plunger is limited by a body of the downhole pump.

18. A virtual pipeline method for providing artificial lift, the method comprising:

liquefying natural gas to fill a transport trailer at an offsite facility;

transporting the trailer to a site of a well; and coupling the trailer to surface equipment to enable the surface equipment to obtain liquefied natural gas (LNG) as needed for pressurizing and depressurizing a hydraulic line with compressed natural gas (CNG) to drive a downhole pump that forces fluid from the well.

19. The method of claim 18, further comprising:

replacing an emptied trailer at the site with a non-empty trailer of LNG; and returning the emptied trailer to the offsite facility for filling.

20. The method of claim 18, wherein the CNG hydraulically reciprocates a plunger within a body of the downhole pump.

* * * * *